United States Patent [19]

Ancona et al.

[11] Patent Number: 4,895,260

[45] Date of Patent: Jan. 23, 1990

[54] RACK FOR CYLINDRICAL CONTAINERS

[75] Inventors: Jane Ancona; Bruce Ancona, both of New York, N.Y.

[73] Assignee: M. Kamenstein, Inc., White Plains, N.Y.

[21] Appl. No.: 352,245

[22] Filed: May 16, 1989

[51] Int. Cl.[4] ..... A47B 73/00

[52] U.S. Cl. ..... 211/77; 211/163

[58] Field of Search ..... 211/77, 78, 71, 131, 211/13, 74, 163

[56] References Cited

U.S. PATENT DOCUMENTS

| | | | |
|---|---|---|---|
| 877,064 | 1/1908 | Edsell | 211/74 X |
| 938,809 | 11/1909 | Alexander | 211/77 X |
| 1,756,883 | 4/1930 | Russell | 211/74 |
| 2,950,155 | 8/1960 | Schick | 211/163 X |
| 3,275,159 | 9/1966 | James et al. | 211/163 X |
| 3,693,807 | 9/1972 | Larson | 211/163 |
| 4,216,867 | 8/1980 | Sturm | 211/77 |
| 4,269,124 | 5/1981 | Rosenthal et al. | 211/163 X |
| 4,700,850 | 10/1987 | Morgan et al. | 211/163 X |

*Primary Examiner*—Alvin C. Chin-Shue
*Assistant Examiner*—Sarah A. Lechok
*Attorney, Agent, or Firm*—Henry R. Lerner

[57] ABSTRACT

A device for holding and displaying a plurality of containers of a cylindrical nature having a circumferential wall, a bottom wall, and an opening opposite the bottom wall provided with a closure. The device comprises three chambers circumferentially spaced about a central vertical axis, each of the chambers comprising a vertically-extending planar support wall, the planar support wall having at least one aperture through which one of the containers may be inserted, and back-up walls associated with the support wall in spaced relation thereto, whereby a container inserted through the aperture is supported by engagement of its circumferential wall of the aperture and by engagement of its bottom wall with the back-up wall.

20 Claims, 4 Drawing Sheets

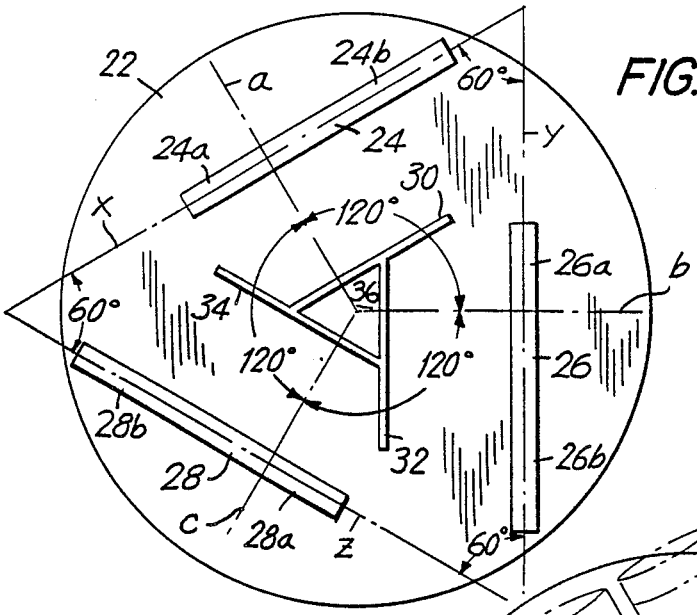
FIG. 2
FIG. 3
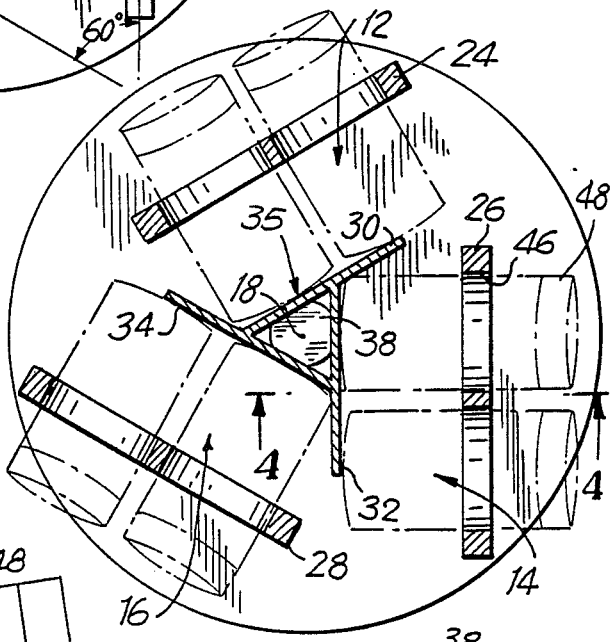
FIG. 4
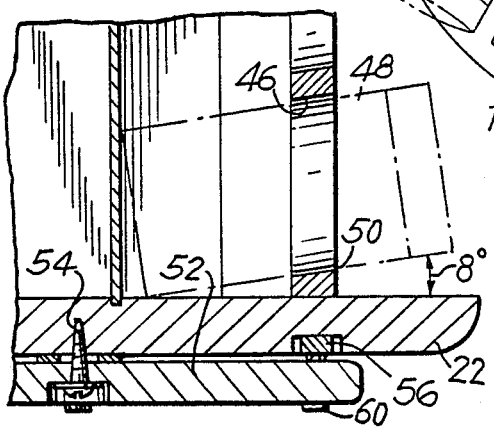
FIG. 5
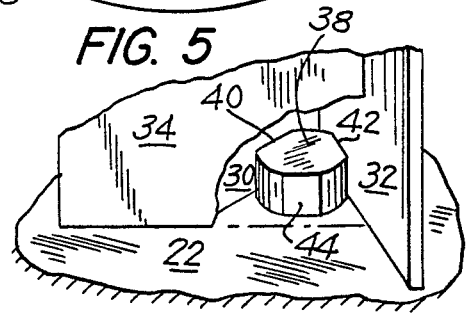

RACK FOR CYLINDRICAL CONTAINERS

BACKGROUND OF THE INVENTION

The present invention relates generally to devices for holding in a pre-arranged pattern a plurality of containers for items such as spices, and more particularly to a spice rack having an asymmetrical arrangement of three chambers wherein a maximum number of spice containers may be stored and displayed in a minimum amount of space.

Space is a major concern in today's world. It is a consideration that has permeated every aspect of modern society. The rapid growth of the world's population within limited space, and the ever-increasing cost of living, among other factors, have made space in this world an increasingly invaluable commodity, be it for living, work, or recreation.

In the everyday world of the kitchen, space has always been a highly-valued commodity. Nothing is more frustrating than to attempt to prepare a meal in a small kitchen. Moreover, due to the ever-increasing sophistication of the art of cooking, many kitchens are replete with special cooking utensils and devices to assist in food preparation. These devices, e.g., blenders, mixers, microwave ovens, etc., are often bulky. Accordingly, there never seems to be enough counter, drawer and shelf space, even in the most modern and spacious of kitchens.

The storage and accessibility of spices has always been a perplexing challenge, especially since the number and variety of spices used in preparing today's meals has increased significantly. Typically, spice racks are constructed of a plurality of rows of compartments for holding a plurality of containers. The rows are either stacked vertically on top of each other, as in U.S. Pat. No. 4,064,992, or stacked vertically in stepwise fashion, as in U.S. Pat. No. 4,378,889. These proposed devices are deficient in that an inordinate amount of space is required to hold a significant number of spice containers. For example, the proposed rack in U.S. Pat. No. 4,064,992 requires a great amount of wall space to be suitable for a large number of spice containers. Conversely, the proposed spice rack of U.S. Pat. No. 4,378,889 eliminates a portion of the required wall space, due to its stepwise, staircase configuration, but significantly increases the depth of the space necessary in order to be useable for a large number of spice containers. It is not unusual today for a kitchen to be stocked with a supply of as many as 24 different spices and herbs. Spice racks hitherto proposed cannot accommodate such an extensive inventory without occupying excessive wall space and/or counter or shelf space.

Accordingly, the need still exists for a spice rack capable of holding a large number of spice containers therein, which occupies a minimum amount of kitchen space while providing ready identification and accessibility of its contents.

SUMMARY OF THE INVENTION

It is an object of the present invention to provide a device for storing and displaying a plurality of containers of a cylindrical nature having a circumferential wall, a bottom wall and an opening opposite the bottom wall provided with a closure, wherein a maximum number of the containers is accessibly contained within a minimum amount of space.

A further object of the present invention is to provide a spice rack which maximizes the volume of containers within the confines of the spice rack while minimizing the amount of effective kitchen space occupied by the spice rack.

These and other objects are achieved, in accordance with the present invention, by a device for holding and displaying a plurality of containers comprising means defining three chambers circumferentially and asymmetrically spaced about a central vertical axis, each chamber comprising a vertically-extending planar support wall and a vertically-extending planar back-up wall in parallel spaced relation to the support wall. Each support wall includes means defining at least one aperture through which one of the containers may be inserted. A container inserted through an aperture is supported by engagement of its circumferential wall with the means defining the aperture and by engagement of its bottom wall with the associated back-up wall. Each vertical back-up wall is spaced from its associated support wall such that at least half of a container can be inserted through an aperture before contacting the back-up wall, thereby preventing inserted containers from slipping out of its chamber.

Preferably, each chamber is apertured to hold eight containers, in two vertical rows of four containers each. Moreover, it is also preferable to bias the apertures inwardly to further prevent containers from slipping out of the chambers. The device may be provided with means mounting the chambers for rotation about the central vertical axis of the device, to provide easy access to all three chambers regardless of where the device is located.

In accordance with the invention, the device supports a maximum number of containers on their circumferential walls within a given volume of space. To achieve this end, the planes of the three support walls intersect so as to define the sides of a first equilateral triangle and the planes of the three back-up walls intersect so as to define the sides of a second equilateral triangle, the sides of the first and second equilateral triangles being in spaced parallel relation to each other, the centers of the first and second equilateral triangles being coincident with the central vertical axis of the device. The three planar support walls are arranged asymmetrically such that the three planes from the central vertical axis and perpendicular to the three planar support walls, respectively, are 120 degrees apart and intersect the planar support walls in a non-bisecting manner. Additionally, each planar back-up wall is arranged to extend from approximately midway of one of the two remaining back-up walls and to receive at its own midway point the end of the other of the two remaining back-up walls. Such geometric relationship defines a configuration which provides for the placement of a maximum number of containers circumferentially about the central vertical axis, wherein the radius of the device is only slightly larger than the height of a container.

In accordance with the invention, a curvilinear wall structure extending between and interconnecting confronting vertical edges of adjacent vertical planar support walls may be provided. Such an interconnecting wall structure results in a substantially closed device, the only access to the three circumferentially and asymmetrically spaced chambers being through the apertures in the support walls.

BRIEF DESCRIPTION OF THE DRAWINGS

The invention will now be described and will be better understood with reference to the accompanying drawings, in which:

FIG. 2 is a sectional view taken along the line 2—2 in FIG. 1;

FIG. 3 is a sectional view similar to FIG. 2 illustrating the geometric relationship of the support walls and back-up walls of the spice-rack of the present invention.

FIG. 4 is a sectional view taken along the line 4–4 in FIG. 3 enlarged scale;

FIG. 5 is a perspective view, partially cut-away, of a central base portion of the spice rack shown in FIG. 1, on an enlarged scale;

DETAILED DESCRIPTION OF THE PREFERRED EMBODIMENTS

Figure 1:
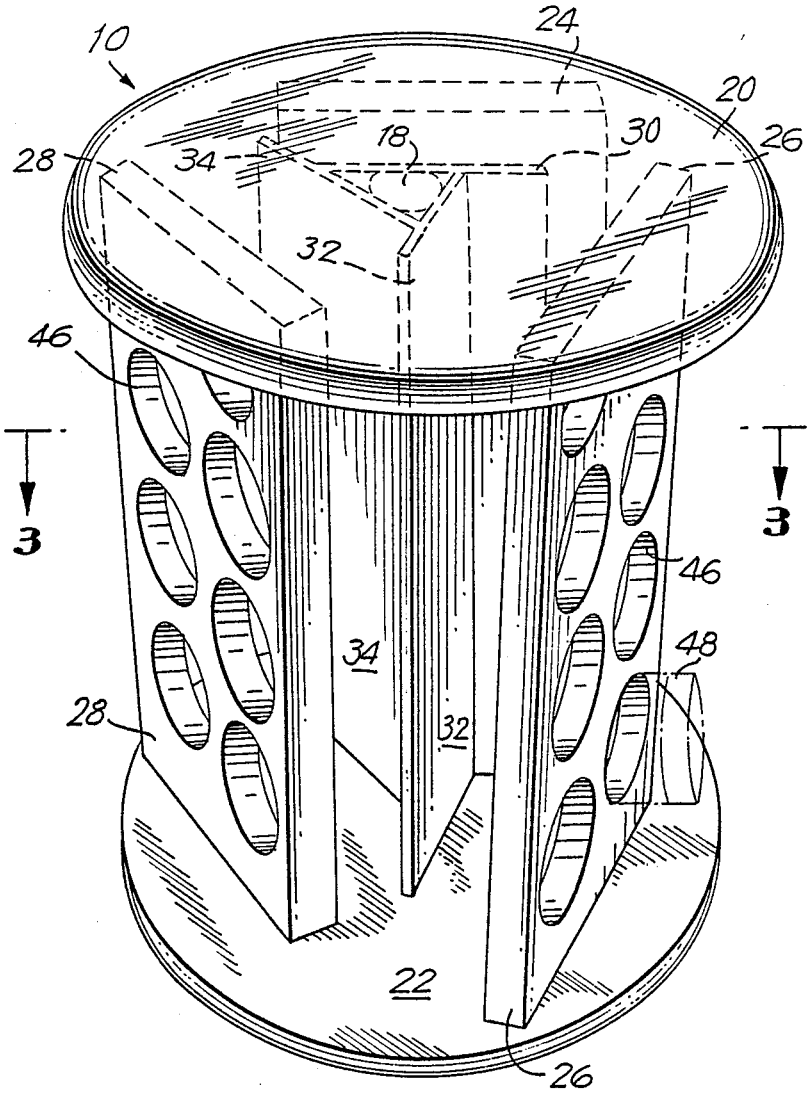
FIG. 1 is a perspective view of a first embodiment of a spice rack made in accordance with the present invention.

Referring to FIGS. 1 to 5, a spice rack made in accordance with the invention, generally indicated at 10, is composed of three vertical chambers generally indicated at 12, 14 and 16 circumferentially spaced about a central axis 18 and extending between a top member 20 and a base member 22. Chamber 12 is defined by a vertical support wall 24 and a vertical back-up wall 30 positioned in parallel spaced relation with vertical support wall 24. Similarly, chambers 14 and 16 are defined by vertical support walls 26 and 28 in parallel spaced relation with vertical back-up walls 32 and 34, respectively.

Vertical back-up walls 30, 32, 34 are interconnected to form an integral centrally-situated back-up wall assembly 35. In this regard, one end edge of each back-up wall is secured to an adjacent back-up wall approximately midway thereof and at an angle of approximately 60 degrees. Thus, and as best shown in FIG. 2, back-up wall 30 has one end edge secured to back-up wall 34, as at 37. Back-up walls 32 and 34 are similarly secured to back-up walls 30 and 32, respectively. Accordingly, the interconnected walls 30, 32, 34 define therewithin a vertically-elongated chamber 36 whose cross-section is a small equilateral triangle formed by inner portions of walls 30, 32, 34. This configuration, as will be described in more detail hereinafter, maximizes the number of containers which may be placed in the rack about central axis 18.

Each support wall 24, 26, 28 is characterized by two vertical rows of apertures 46, which conform in size and shape to the containers to be supported therewithin. As shown in the drawings, apertures 46 are circular, which conforms to the circumferential shape of container 48. However, as will be readily apparent to one of ordinary skill in the art, the shape of apertures 46 may be square, rectangular, or any shape necessary to conform to the circumferential shape of a given spice container.

As best shown in FIGS. 2 and 4, a container 48 is inserted through aperture 46 in support wall 26 until the bottom wall of the container engages the back-up wall against which it will rest. As shown in FIG. 4, walls 50 of apertures 46 incline inwardly slightly from the horizontal, preferably at an angle of about 8 degrees for biasing containers 48 into engagement with back-up walls 30, 32, 34.

Support walls 24, 26, 28 are formed as planar walls lying in vertical planes x, y and z, respectively, which planes intersect each other at 60 degree angles, as best shown in FIG. 3, to form an equilateral triangle. The sides of the equilateral triangle are in parallel spaced relation to sides 30, 32, 34, respectively, of back-up wall assembly 35, as shown in FIG. 3. The planes of the three support walls 24, 26, 28 thus intersect to define sides of a first equilateral triangle and the planes of the three back-up walls 30, 32, 34 intersect to define sides of a second equilateral triangle. The sides of the first and second equilateral triangles are in parallel spaced relation. The first and second equilateral triangles have geometric centers coincident with each other and with central vertical axis 18. As best shown in FIG. 3, there is an asymmetrical relationship between the three chambers. More specifically, the three planar support walls 24, 26, 28 are arranged such that planes a, b, c extending through central vertical axis 18 and perpendicular, respectively, to the planar support walls 24, 26, 28 are 120 degrees apart and intersect the planar support walls 24, 26, 28 in a non-bisecting manner to divide the support walls into smaller sections **24*a*, 26*a*, 28*a* and relatively larger sections 24*b*, 26*b*, 28*b*. This asymmetrical configuration makes it possible to hold a maximum number of spice containers 48 about the central vertical axis 18 of the spice rack. The containers 48 in any chamber extend in a direction about 120 degrees from the direction containers 48 in either adjacent chamber extend, as shown in FIG. 2**.

Accordingly, as best shown in FIG. 2, the geometric interrelationship of support walls 24, 26, 28 and back-up walls 30, 32, 34 enables maximum utilization of space about central vertical axis 18 of the spice rack. The containers 48 occupy nearly all the space in a horizontal plane about central vertical axis 18, the only unoccupied space essentially being that within the inner equilateral triangle of back-up wall assembly 35. Thus, as shown in FIG. 2, six spice containers 48 having a given diameter and height can be accommodated circumferentially in a spice rack whose radius is only slightly greater than the height of the container.

Assuming standard spice bottles of 1.75" diameter and 3.725" in height, a spice rack according to the embodiment of FIGS. 1 to 5 has a total height of 10" and a diameter of 8.5". Each aperture 46 has a diameter of about 1.77", a depth of about 0.43" and is biased inwardly at about 8 degrees. The distance between the centers of adjacent apertures is about 2.03" vertically and about 1.93" laterally. The transverse dimension of each back-up wall 30, 32, 34 is about 2.687" and the transverse dimension of each support wall 24, 26, 28 is about 4.45". The distance between the outer wall of each support wall 24, 26, 28 and the contact surface of each back-up wall 30, 32, 34 is about 2.25".

A spice rack thus dimensioned accommodates 24 spice containers. Each container is biased inwardly at an angle of about 8 degrees and rests against a back-up wall. The spacing between an associated support wall and back-up wall is a function of the height of a container to be supported thereby. At least about half the height of a container must extend between a support wall and back-up wall to prevent the container from falling out of the chamber defined thereby. The apertured wall supports the container in the chamber along its circumferential surface and, due to its thickness, prevents any significant pivoting of the container. No other support is required underneath the container The bottom of the container rests against the back-up wall. The container is thus removably but securely maintained in the chamber at a biased angle, with slightly greater than half the container extending between the support wall and the back-up wall. This bias increases the pressure of contact between the base of the container and the back-up wall, further minimizing any tendency of the container to pivot in its aperture or to slip out of its chamber.

In comparison to spice racks known in the prior art, the present invention allows storage of 24 spice containers in a relatively small volume of space, while retaining ease of access to and identification of the spice containers. Regardless of which prior art spice rack is employed, substantially more height, width and/or depth would be required to accommodate as many spice containers while maintaining an ornamentally acceptable standard.

As shown in FIG. 4, the spice rack is provided with a stationary base 52. Base member 22 may be rotatably mounted on base 52 by means of a central pivot spring 54 and ball bearings 56, and is provided with rubber pads 60 for stability. Accordingly, spice rack 10 may be placed for use in a variety of places and the various chambers accessed by simply rotating the rack about base 52.

Accordingly, the spice rack of the present invention can be used anywhere with equally advantageous results in terms of space saving, access and identification. The spice rack of the present invention can be placed on a counter or shelf, in a cupboard or pantry, with no surrounding walls or up to three surrounding walls, and function equally as effectively, especially when provided with means for rotating the rack.

The spice rack of the present invention may be constructed of any suitable material, such as wood or plastic, and may be made by conventional molding and extrusion processes. For example, the central back-up wall assembly 35 composed of vertical planar back-up walls 30, 32, 34 may be extrusion molded as a single integral piece.

In order to position the back-up assembly 35 such that each of back-up walls 30, 32, 34 is aligned parallel to its respective support wall, a central faceted dowel 38 may be provided. Dowel 38 is secured to base 22 such that each of sides 40, 42, 44 thereof is aligned parallel to a respective one of walls 24, 26 or 28. The back-up assembly 35 can then be positioned about dowel 38 such that back-up walls 30, 32, 34 rest against dowel sides 40, 42, 44, respectively, thus positioning each back-up wall parallel to its respective support wall. It will be appreciated that the use of dowel 38 is merely a convenient manner of achieving the intended end, which is parallel spaced relation of back-up walls 30, 32, 24 and support walls 24, 26, 28.

Figure 6:
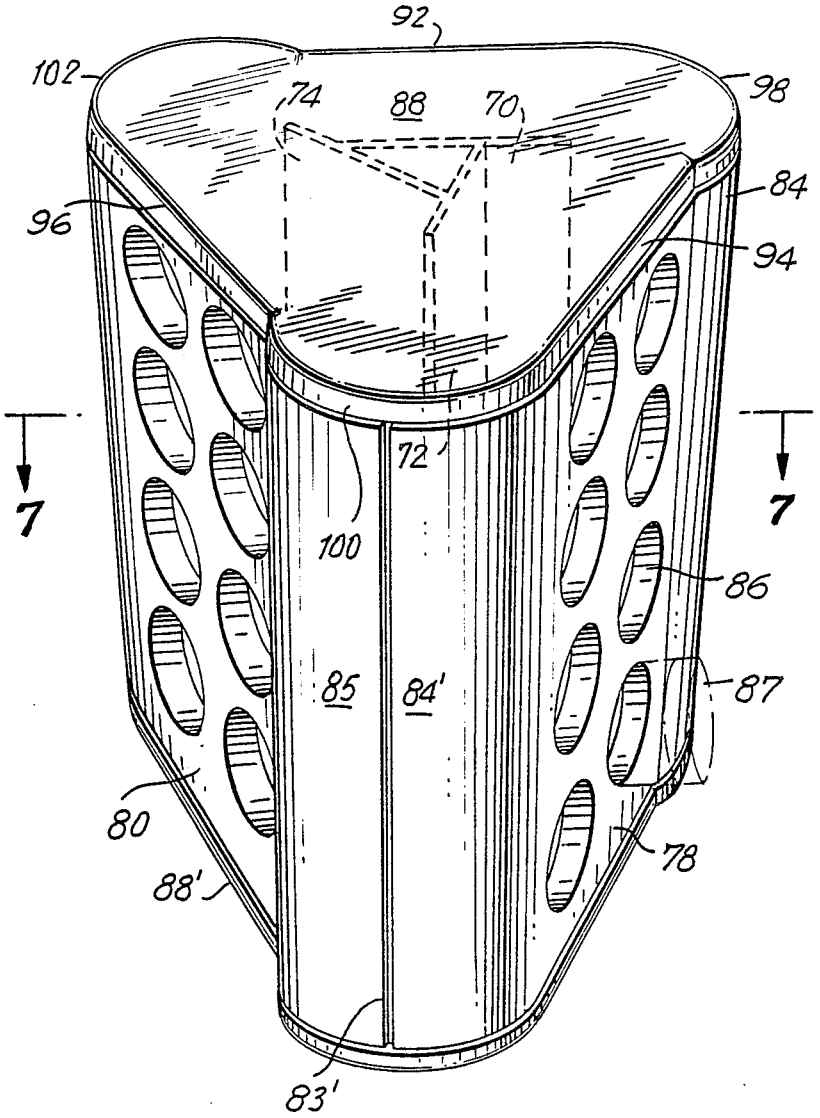
FIG. 6 is a perspective view of a second embodiment of a spice rack made in accordance with the present invention.
Figure 7:
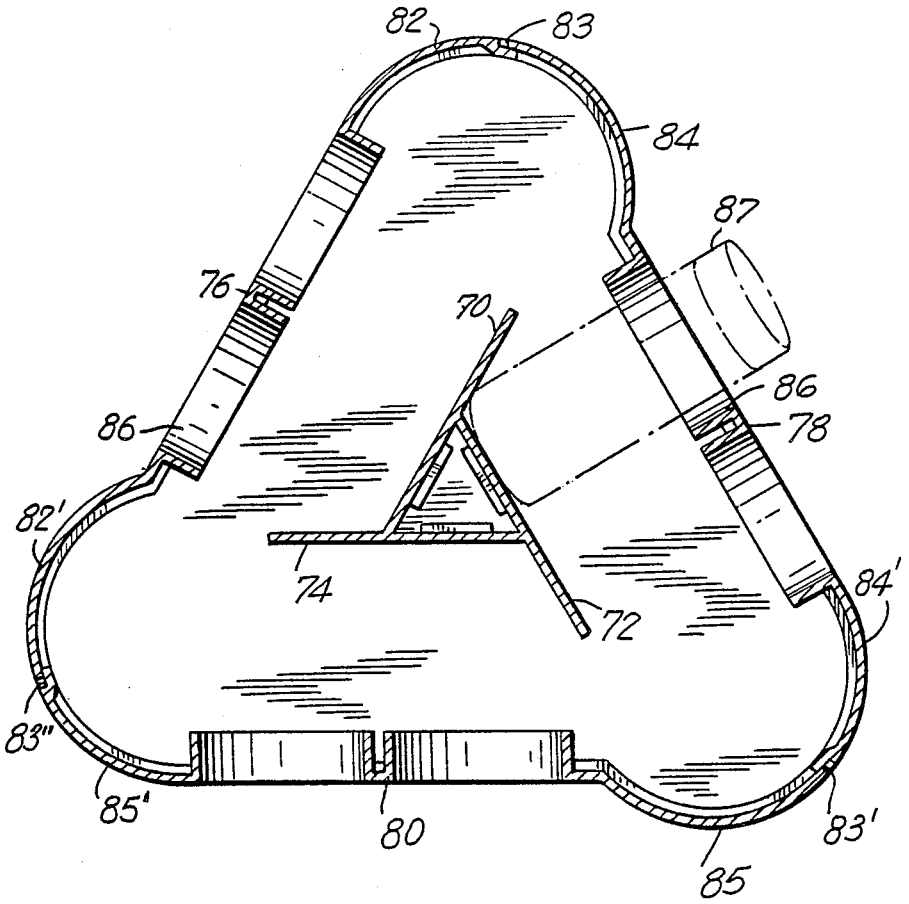
FIG. 7 is a sectional view taken along the line 7—7 in FIG. 6.

Referring to FIGS. 6 and 7, there is shown a second embodiment of the present invention in which the geometry is identical to that of the first embodiment in all respects in order to provide optimum utilization of space. What has been added in this second embodiment is a curvilinear wall structure extending between and interconnecting confronting vertical edges of adjacent vertical planar support walls to provide a substantially closed-wall device.

Specifically, as shown in FIGS. 6 and 7, a central back-up assembly of three vertical planar back-up walls 70, 72, 74 interconnected at about 60 degrees is provided, as in the embodiment of FIGS. 1 to 5. Similarly, vertical planar support walls 76, 78, 80 formed in vertical planes intersecting at 60 degrees and parallel to respective support walls 70, 72, 74 in spaced relation are also provided.

However, contrary to the first embodiment, in which an essentially open framework device is provided, the embodiment of FIGS. 6 and 7 provides an essentially closed-wall device. Thus, support wall 76 is provided at its opposite side edges with an inwardly curvilinear wall extension 82 and an outwardly curvilinear wall extension 82'. Similarly, support wall 78 is provided with outwardly curvilinear wall extension 84 and inwardly curvilinear wall extension 84', while support wall 80 is provided with outwardly curvilinear wall extension 85 and inwardly curvilinear wall extension 85'. Wall extensions 82 and 84 are joined at 83, wall extension 84' and 85 are joined at 83', and wall extensions 85' and 82' are joined at 83'', thus providing a totally enclosed curvilinear outer wall structure, the only openings in the outer surface being the apertures 86 in each support wall for receiving spice containers 87.

Similarly, a top member 88 and base member 88' are provided, but they are not of cylindrical configuration. Specifically, top member 88, as shown in FIG. 6, is contoured with straight edges 92, 94, 96 alternating with curvilinear edges 98, 100, 102. Straight edges 92, 94, 96 align with the planar edges of support walls 76, 78, 80, respectively. Curvilinear edge 98 aligns with the contours of curvilinear wall extensions 82, 84; curvilinear edge 100 aligns with the contours of curvilinear wall extensions 84', 85; and curvilinear edge 102 aligns with the contours of curvilinear wall extensions 85', 82' provided on each of the support walls. The base member 88' is contoured and constructed similarly to top member 88 and need not be described further.

This second embodiment is particularly suitable for manufacture by plastic extrusion. Top member 88, base member 88' and central back-up assembly 70, 72, 74 can each be molded as integral pieces. Further, each support wall 76, 78, 80 with its respective curvilinear and asymmetrical wall extensions (82, 84), (84', 85), or (85', 82') can be extrusion molded as an integral piece, thus providing an essentially closed curvilinear structure of asymmetrical container chambers which is easily assembled. Additionally, this embodiment also provides an attractive spice rack which protects and masks a major portion of the spice containers placed therein, providing an aesthetic appearance and also preventing the containers from becoming soiled by dust, kitchen grease, etc. In effect, a portable spice "cabinet" is provided, while retaining the important functions of spice container access and identification.

It will be understood that the specification and preferred embodiments are illustrative but not limitative of the present invention. Other embodiments within the spirit and scope of the invention will suggest themselves to those skilled in the art. For example, while the embodiments described above employ vertical rows of 4 apertures each, it will be readily appreciated that more or fewer than 4 apertures may be employed, depending on the desired total height of the spice rack.

Having thus described my invention, what I claim and desire to secure by letters patent is:

1. A device for holding and displaying a plurality of containers of a cylindrical nature having a circumferential wall, a bottom wall, and an opening opposite said bottom wall provided with a closure, comprising means defining three chambers circumferentially spaced about a central vertical axis, each of said chambers comprising a vertically-extending planar support wall, said planar support wall being provided with means defining at least one aperture through which one of said containers may be inserted, the planes of said three planar support walls intersecting to define sides of a first triangle, and back-up means associated with said support wall in spaced relation thereto, whereby a container inserted through said aperture is supported by engagement of its circumferential wall with the means defining the aperture and by engagement of its bottom wall with said back-up means, and whereby there is maximum utilization of the space in said device.

2. A device as set forth in claim 1, wherein said back-up means comprises a vertical planar back-up wall in parallel spaced relation to said support wall.

3. A device as set forth in claim 2, wherein said first triangle is an equilateral triangle and wherein the planes of said three planar back-up walls intersect to define sides of a second equilateral triangle, the sides of said second equilateral triangle being in spaced parallel relation with the sides of said first equilateral triangle.

4. A device as set forth in claim 1, wherein said three planar support walls are arranged so that perpendicular planes from said central vertical axis to said three planar support walls are 120 degrees apart and intersect said planar support walls in a non-bisecting manner.

5. A device as set forth in claim 4, wherein said perpendicular planes intersect said planar support walls to define a smaller planar wall segment and a larger planar wall segment having a horizontal length ratio of approximately 1:3.

6. A device as set forth in claim 2, wherein each planar back-up wall extends from approximately midway of a first of the remaining back-up walls and receives at its midway point the end of the second of the remaining back-up walls.

7. A device as set forth in claim 1, wherein each means defining an aperture is biased inwardly to prevent inserted containers from sliding out of said apertures.

8. A device as set forth in claim 7, wherein each means defining an aperture is biased inwardly at an angle of about 8 degrees.

9. A device as set forth in claim 1, further comprising means mounting said chambers for rotation about said central vertical axis.

10. A device as set forth in claim 1, wherein said aperture-defining means defines at least one vertical row of four apertures.

11. A device as set forth in claim 1, further comprising means defining a wall extending between and interconnecting confronting side edges of said support walls to form a substantially closed device.

12. A device as set forth in claim 11, wherein said walls extending between and interconnecting said confronting side edges of said support walls are curvilinear.

13. A device as set forth in claim 12, wherein said back-up means comprises a vertical planar back-up wall in parallel spaced relation to said support wall.

14. A device as set forth in claim 13, wherein said first triangle is an equilateral triangle and the planes of said three planar back-up walls intersect to define sides of a second equilateral triangle, the sides of said second equilateral triangle being in spaced parallel relation with the sides of said first equilateral triangle.

15. A device as set forth in claim 12, wherein said three planar support walls are arranged so that perpendicular planes from said central vertical axis to said three planar support walls are 120 degrees apart and intersect said planar support walls in a non-bisecting manner.

16. A device as set forth in claim 15, wherein said perpendicular planes intersect said planar support walls to define a smaller planar wall segment and a larger planar wall segment having a horizontal length ratio of approximately 1:3.

17. A device as set forth in claim 13, wherein each planar back-up wall extends from approximately midway of a first of the remaining back-up walls and receives at its midway point the end of the second of the remaining back-up walls.

18. A device as set forth in claim 12, wherein each means defining an aperture is biased inwardly to prevent inserted containers from sliding out of said apertures.

19. A device as set forth in claim 12, further comprising means mounting said chambers for rotation about said central vertical axis.

20. A device as set forth in claim 12, wherein said aperture-defining means defines at least one vertical row of four apertures.

* * * * *